US005168824A

United States Patent [19]

Ketterman

[11] Patent Number: 5,168,824

[45] Date of Patent: Dec. 8, 1992

[54] FOIL SUSPENDED WATERCRAFT

[76] Inventor: Greg S. Ketterman, 3215 Hackett St., Long Beach, Calif. 90808

[21] Appl. No.: 632,175

[22] Filed: Dec. 21, 1990

Related U.S. Application Data

[63] Continuation-in-part of Ser. No. 571,729, Aug. 24, 1990, abandoned, which is a continuation-in-part of Ser. No. 453,700, Dec. 20, 1989, abandoned.

[51] Int. Cl.[5] ..... B63B 1/28

[52] U.S. Cl. ..... 114/276; 114/61; 114/275

[58] Field of Search ..... 114/91, 274, 275, 276, 114/277, 280, 279, 281, 282, 283, 61, 123

[56] References Cited

U.S. PATENT DOCUMENTS

| | | | |
|---|---|---|---|
| 2,387,907 | 10/1945 | Hook | 114/280 |
| 2,708,894 | 5/1955 | Hook | 114/277 |
| 2,890,671 | 6/1959 | Hobday | 114/275 |
| 3,324,815 | 6/1967 | Morales | 114/66.5 |
| 3,762,353 | 10/1973 | Shutt | 114/281 |
| 3,789,789 | 2/1974 | Cleary | 114/280 |
| 3,949,695 | 4/1976 | Pless | 114/274 |
| 4,192,247 | 3/1980 | Riordan | 114/91 |
| 4,711,195 | 12/1987 | Shutt | 114/274 |
| 5,063,869 | 11/1991 | Bielefeldt | 114/283 |

FOREIGN PATENT DOCUMENTS 591933 9/1947 United Kingdom .

*Primary Examiner*—Sherman Basinger
*Assistant Examiner*—Thomas J. Brahan
*Attorney, Agent, or Firm*—Fulwider, Patton, Lee & Utecht

[57] ABSTRACT

A hydrofoil suspension system which maintains a watercraft in a desired attitude relative the water's surface. Pitching and rolling forces are automatically controlled while the system is resistant to destabilization by localized surface irregularities.

43 Claims, 3 Drawing Sheets

FOIL SUSPENDED WATERCRAFT

This is a continuation-in-part of copending U.S. patent application Ser. No. 07/571,729 filed on Aug. 24, 1990 now abandoned, which is a continuation-in-part of U.S. patent application Ser. No. 07/453,700 filed Dec. 20, 1989 now abandoned.

BACKGROUND OF THE INVENTION

1. Field of the Invention

The present invention relates to hydrofoil supported watercraft and more particularly pertains to systems for adjusting a hydrofoil's angle of attack in order to maintain the craft in a desired attitude relative to the water's surface.

2. Description of the Prior Art

The use of hydrofoils for supporting a moving watercraft has had wide consideration in the recent past. These considerations stem from the hydrodynamic advantages inherent in a hydrofoil. Specifically, the several drag components associated with conventional displacement hull designs and even planing hull designs generated substantial power requirements for propulsion which ultimately limits the watercraft's speed and efficiency. Hydrofoils, adapted to lift all or a portion of a watercraft's hull clear of the water serve to alleviate hydrodynamic drag otherwise associated with the hull while the surface drag or form drag generated instead by the hydrofoils is comparatively minimal due to the foil's relatively small surface area and clean form. That component of drag generated by a hydrofoil known as induced drag or drag-due-to-lift, can further be reduced by increasing the foil's aspect ratio.

The minimal amount of hydrodynamic drag generated by hydrofoil suspended watercraft clearly enables available power to be used more efficiently. Such enhanced efficiently can manifest itself in terms of higher speed capabilities, reduced fuel consumption rates or can be exploited by the fitment of smaller powerplants without compromising a craft's performance ability. A reduction in drag is particularly attractive for windpowered watercraft for which typically only a limited amount of useable power is available as structural as well as dynamic considerations restrict the amount of sail area that can practically be exposed to the wind while light winds reduce the amount of power available altogether. A large variety of foil systems have consequently been fitted to both sailboats as well as power boats.

The amount of lift generated by a hydrofoil is dependent upon both its velocity through water as well as its angle of attack. Higher velocities and/or larger attack angles serve to increase lift. In order to limit the amount of lift, so as to maintain an optimal degree of submersion and thereby minimize drag, a variety of systems have been devised that automatically adjust the foil's angle of attack as a function of its submersion. Examples of such systems are set forth in U.S. Pat. Nos. 3,762,353, and 4,711,195 as well as British Patent No. 591,933 wherein leading buoyant or planing members are employed to gauge the foil's submersion. These gauging members follow the water's surface contour and are directly linked to a mechanism that increases the foil's attack angle as a function of the foil's position below the reference plane defined by the gauging members' position. While the described systems are suitable for their intended purposes, the efficiency and stability of craft employing such systems breaks down as velocity increases because the gauging members attempt to doggedly follow the local wave contour. The local wave action is perceived as undulating at higher and higher frequencies as the craft's speed increases and as a result, exaggerated or unnecessary adjustments of the foil's attack angle are made in response to the gauging member's movements. A system is therefore called for that adjusts foil angle in response to the craft's general attitude relative the overall water surface rather than in response to local wave contour in order to provide a more stable suspension of the craft at high speeds.

Systems employing multiple adjustable hydrofoil surfaces have been adapted to watercraft in an attempt to control rolling forces and more specifically, have been used to control the healing of windpowered watercraft. A representative example is described in U.S. Pat. No. 4,949,695. By adjusting the windward hydrofoil's attack angle to produce negative lift while adjusting the leeward hydrofoil's attack angle to generate positive lift the crank is maintained in a more upright orientation. This not only serves to reduce the tendency to capsize, but maximizes the surface area exposed to the wind. Higher speeds can therefore safely be attained. Disadvantages associated with prior art designs are inherent in the manner in which the foils' attack angles are controlled wherein stability and effectiveness quickly diminishes as higher and higher speeds are attained. The previously disclosed systems would appear to either react too slowly or inappropriately as in the case of manually operated systems or in systems wherein the foils' attack angles are linked to the position of the boom. Conversely, systems employing linkages that are directly responsive to the foils' submersion level below the local surfaces contour suffer from the same destabilizing effects at higher speeds that were discussed above. A hydrofoil suspension system is therefore called for that more effectively controls a watercraft's rolling motion at high speeds.

SUMMARY OF THE INVENTION

The above-indicated shortcomings of the prior art are overcome by the hydrofoil suspension system of the present invention. The system provides for the adjustment of the foil surface's attack angle in response to the input of a mechanism that senses the level of the water's surface yet filters out high frequency undulations. The system therefore supports and maintains the craft at a substantially constant height without unnecessary or inappropriate corrections that would otherwise result in instability or inefficiencies. Such system thereby provides a smooth, steady, and controlled support for the craft at speed.

By supporting the watercraft on two or more such foil suspension systems, the attitude of the entire craft is controllable to provide enhanced stability as well as efficiency. The adaptation of such systems to windpowered watercraft effectively controls heeling forces thus allowing higher speeds to be achieved.

More specifically the present invention calls for one or more hydrofoil surfaces to be positioned below a watercraft and oriented so as to generate lift as the watercraft proceeds through the water. The hydrofoils are held in position via a support arm that pivots on an axis oriented substantially along the horizontal and perpendicularly to the watercraft's longitudinal axis. As a result, the hydrofoil, rigidly attached to the distal end of the support arm, undergoes attack angle changes as the support arm is pivoted back and forth. The position of the support arm and hence the hydrofoil's attack angle is biased towards a preselected position. A canard, as for example a float or planing surface that senses the position of the water's surface relative the watercraft, is linked to the support arm so as to convert vertical displacement of the canard into a pivoting motion of the control arm. The interconnection between the control arm and float is achieved by a flexible cantilever, the flexibility or resiliency of the cantilever being selected such that high frequency undulations of the canard are not transmitted to the control arm. Consequently, angle changes of the hydrofoil do not result from high frequency movement of the canard, as encountered for example when the watercraft moves across choppy water at high speed.

The control arm can be pivotably attached to watercraft in a number of ways. One preferred method requires the mounting of a transversely oriented torsionally flexible beam to the watercraft so that its ends extend outwardly therefrom. A control arm, with a hydrofoil rigidly attached to its distal end, rigidly and radially depends from each end of the transverse beam. The canards are attached to the control arms such that vertical displacement of the canard causes the flexible beam to be torsionally displaced thus causing the support arm to pivot and hence the hydrofoil's attack angle to change accordingly. Alternatively, a rigid transverse beam can be employed, the ends of which extend laterally from the watercraft and wherein the control and are pivotably mounted to the ends of the beam. A spring biases the control arm and hence the attack angle of the hydrofoil into a desired position. Vertical displacement of the canard in flexible communication with the control arm acts against the spring to effect a movement of the control arm.

The present invention additionally calls for the location of a buoyant body about or near the ends of the transverse beams so as to provide buoyancy when the watercraft is not subject to the lifting forces generated by the hydrofoil surfaces. Additionally, the buoyant bodies are positioned such that their centers of buoyancy impart a moment about the transverse beam's pivoting or flexing axis. As a result, the hydrofoils' attack angle are substantially larger when the watercraft is in its buoyant mode than when the craft is at speed supported by the hydrofoils with the buoyant bodies clear of the water. The invention additionally provides the positioning of a damper or shock absorber mounted so as to control the pivoting of the control arm.

The suspension of the present invention is ideally suited to windpowered watercraft. Two hydrofoils, suspended as described above, are preferably substantially displaced laterally from the center line of the watercraft to provide a stable base, while an inverted T-shaped rudder, positioned near the aft portion of the watercraft, provides steering control as well as lift at speed.

Each control arm and hydrofoil is combined into a single L-shaped blade structure wherein the vertical portion of the "L" provides leeward resistance and the base of the "L" is foil-shaped. The "L" shape is more effective than conventional T-shape designs to provide more lift, more leeward resistance and less drag as the turbulence generated by the second blade tip of a T-shape is eliminated as is the turbulence otherwise generated in the leeward corner of an inverted T. The two L-shaped structures are oriented so as to curve towards one another with their bases extending slightly downwardly. This orientation of the hydrofoil surfaces serves to impart rolling motion resistance to the craft during side slip as the windward foil is deflected downwardly while the leeward foil is deflected upwardly.

Although various rigs are easily adaptable to such a platform, a preferred approach provides for a bi-plane rig, employing two sails each positioned substantially over one of the hydrofoils. Each mast supporting a sail is rigged so as to be isolated from any attack angle adjusting movements of the canard, flexible cantilever, buoyant body, flex beam, or support arm therebelow while a shock absorber extending from the sail's mast to, for instance, the buoyant dampens any relative movement. Such isolation is achieved by locating the base of the mast with a ball-and-socket joint while the head of the mast is held in position relative to the watercraft via a triangulating strut and stay arrangement.

Other features and advantages of the present invention will become apparent from the following detailed description taken in conjunction with the accompanying drawings which illustrate by way of example the principles of the invention.

DESCRIPTION OF THE PREFERRED EMBODIMENT

Figure 2:
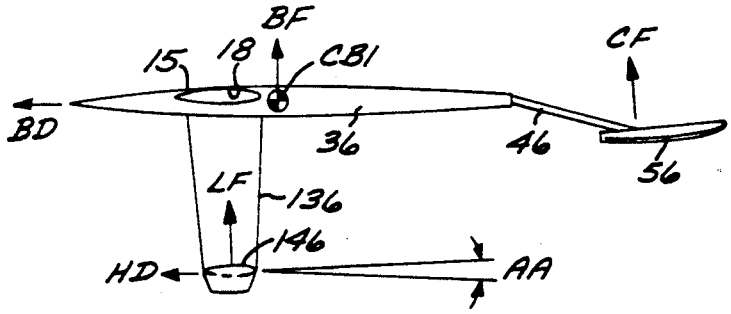
FIG. 2 is an enlarged cross-sectional view taken along line 2—2 of FIG. 1.

FIGS. 1-6, illustrate watercraft in accordance with the present invention. A first embodiment, generally illustrated in FIG. 1, comprises a central elongate hull 11 provided with a cockpit cavity 12 proximate its stern and a mast 14, carrying a sail surface SS, mounted rigidly and vertically on the central portion thereof. A torsionally flexible transverse beam 15 of substantially planar section is rigidly mounted to, and extends across, the central hull subjacent the base of mast 14 to present attachment mountings 16 and 17 at the free ends thereof. Each of the mountings, in turn, rigidly engages a corresponding outrigger assembly 26, 27 each including a corresponding hollow buoyant body 36, 37. Bodies 36, 37 are of elongated configuration and each fairs to a point at its forward end.

Attached to the underside of each body 36, 37 are downwardly depending blades 136, 137. Each blade 136, 137 is of a narrow, high aspect ratio, plan form turning inwardly at the ends to form hydrofoil surfaces 146, 147. The vertical portion of the blades is of sufficient are to provide leeward resistance to the watercraft. The inwardly turned ends extend slightly downwardly to define a slightly obtuse L-shape.

The stern of the craft is fitted with a rotatable rudder 124 shaped in an inverted "T". The vertical portion 125 of the T-shape provides for the watercraft's steering control while the horizontal portion 126 of the T-shape is foil-shaped and oriented so as to generate lift at speed.

Each outrigger assembly 26, 27 further includes a flexible cantilever 46, 47 extending forwardly from the leading point of each buoyant body 36,37. The cantilever 46,47 is formed or angled to extend slightly downwardly to below the buoyant body and a canard 56, 57 may have a planing shape or be buoyant or both. The flexibility and length of the cantilever is selected in relation to the rotational inertia of each outrigger assembly 26, 27 about the flex beam's axis of flexure 18 so that high frequency vertical displacements of the canard 56, 57 are not transferred beyond the cantilever's attachment point to buoyant body 36, 37. The buoyant bodies are shaped so that their centers of buoyancy CB1, CB2, combined with buoyant and/or dynamic lifting force provided by the canard 56, 57 serve to impart a substantial torsional moment to the beam 15 while the craft is at rest or moving at a slow speed.

Figure 1:
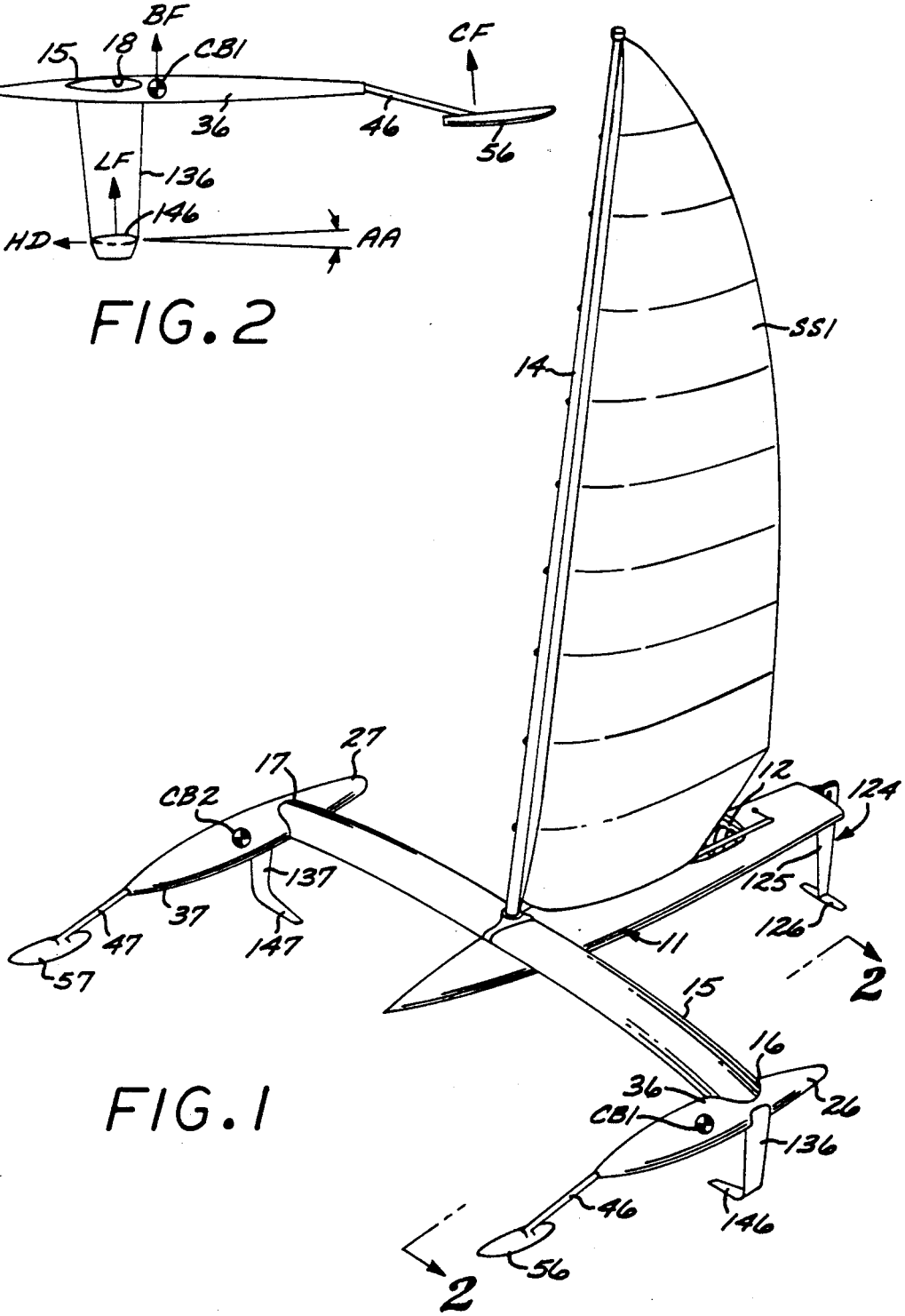
FIG. 1 is a perspective illustration of a watercraft constructed in accordance with the present invention.
Figures 3, 4:
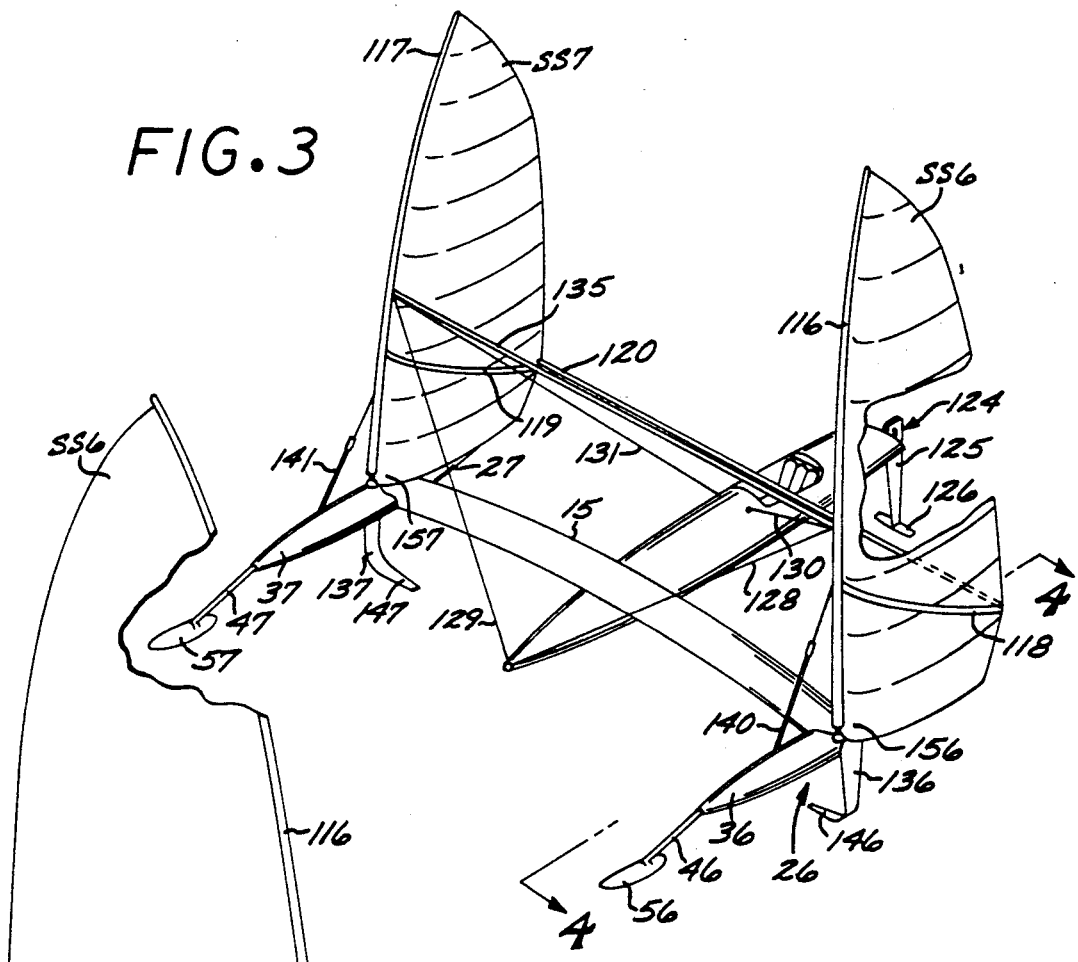
FIG. 3 is a perspective illustration of a preferred embodiment of a watercraft in accordance with the present invention herein.
FIG. 4 is an enlarged cross-sectional view taken along lines 4—4 of FIG. 3.

FIG. 3 illustrates a preferred embodiment of the present invention wherein a craft, substantially as illustrated in FIG. 1 is provided with a bi-plane rig. A mast 116, 117 extends from atop each outrigger assembly 26, 27 to support a sail surface SS6, SS7. The base of each mast is located by a ball and socket joint 156, 157 which serves to isolate the mast 116, 117 from any pivoting movement the outrigger assemblies 26, 27 may undergo. The masts are held upright by a triangulating stay and strut arrangement. Forestays 128, 129 extending from each mast 116, 117 at about half-height to the bow of hull 11 serve to check aft movement while a backstays 130, 131 extend from the masts to the hull 11 near the cockpit 12 to check forward movement. A compression strut 135 extending between the masts 116, 117 in combination with the inward orientation of stays 128, 129, 130, 131 checks all lateral movement. A tie rod 120 interconnects the two booms 118, 119 pivotably depending from masts 116, 117 to control the orientation of the sail surfaces SS6, SS7.

An additional feature well suited for adaptation to the bi-plane rig is the fitment of shock absorbers 140, 141 between the masts 116, 117 and the buoyant bodies 36, 37 to dampen any relative movement therebetween.

Figure 5:
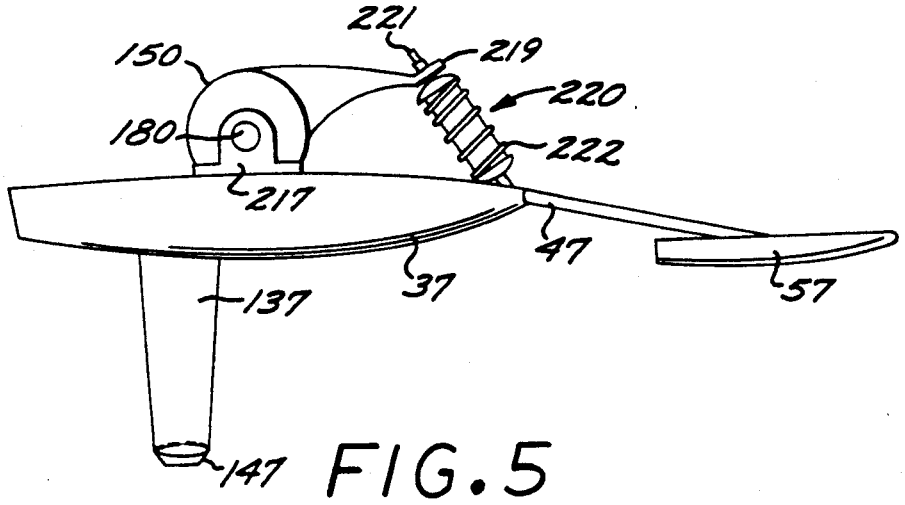
FIG. 5 is a side view detail of an alternate embodiment according to the present invention.

FIG. 5 illustrates an alternative arrangement wherein the torsionally flexible transverse beam 15 of FIGS. 1–4 is replaced with a torsionally rigid beam 150. The entire outrigger assembly is pivotably affixed to beam 150 with bracket 217 and pivots about axis 180. A coil spring 222 is fitted between an appropriate point along the outrigger assembly, such as the forward end of buoyant body 37, and beam 150 to bias the entire assembly into a preselected position. In the example illustrated, a rigid bracket depends from beam 150 to provide a mounting point for the spring 222. In addition, a shock absorber 220 is mounted within spring 222 to dampen the compression and extension movements of the spring.

Figure 6:
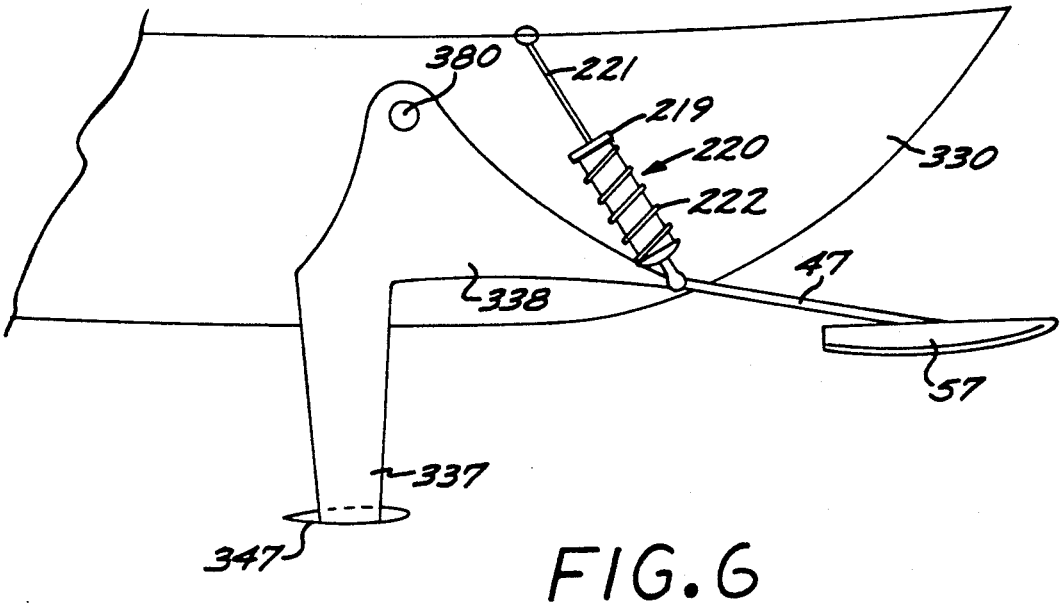
FIG. 6 is a side view detail of an outrigger assembly according to the present invention coformed for use with a powered watercraft.

FIG. 6 illustrates an embodiment of the present invention wherein a hydrofoil suspension system, similar to those previously described, is adapted for mounting to a substantially conventional hull 330. A mechanism is provided to enable a support member 337 to pivot about an axis 380 oriented substantially along the horizontal and substantially perpendicular to the hull's longitudinal axis. In the case of motor powered craft, wherein resistance to leeward movement is not a necessity, the support member 337 is of substantially lesser area than in adaptations for windpowered craft. Additionally, the buoyant bodies of the previously described embodiments is replaced by a bracket 338 that engages pivot 380 and simultaneously interconnects the support member 337 with the flexible cantilever 47 having the canard 57 attached thereto. A spring 222 and shock absorber 220 arrangement, similar to the configuration shown in FIG. 5, is interposed between bracket 338 and hull 330 to bias hydrofoil 347 to assume a preferred attack angle as well as dampen any adjusting movements thereof.

In operation, the above described elements cooperate in the following manner. In the case of the embodiments illustrated in FIG. 1–5, a substantial portion of the buoyancy necessary to keep the craft afloat at rest of low speeds is provided by buoyant bodies 36, 37 or outrigger assemblies 26, 27. The substantial lateral separation of the outrigger assemblies provides rolling stability for the slender central hull 11. As can best be seen in FIGS. 2 and 4, the outrigger assemblies 26, 27 are subjected to and generate a multitude of forces which all cooperate to buoy or lift the craft while automatically stabilizing the craft relative pitching and rolling forces to control the craft's attitude vis-a-vis the water's surface.

As previously discussed, a hydrofoil 146 generates lifting forces LF as a function of attack angle AA and velocity. Larger (more positive) attack angles and greater velocities generate greater lift. At the low speeds, when the watercraft is supported by the buoying force BF of buoyant bodies 36, 37 and therefore subject to a lot of drag BD, it is desirable to increase attack angle AA to maximize lift LF in order to lift the buoyant bodies 36, 37 clear of the water as soon as possible. The forward offset of the buoyant bodies' centers of buoyancy CB1, CB2 relative the flexing or pivoting axes 18, in addition to any buoying forces generated by the canard, creates a moment which causes beam 15 to flex and pivot blades 136, 137 forwardly. This orientation increases the hydrofoils' attack angles AA to increase lift.

As the craft gathers speed, the lift LF generated by water flowing over hydrofoils 146, 147 increases to lift the buoyant bodies 36, 37 (as well as the hull 11) clear of the water. As less and less water is displaced by each buoyant body, the buoyant forces BF decrease thereby reducing the flexure of beam 15. This has the effect of pivoting blades 136, 137 abaft thereby reducing attack angle and the resulting lift. The drag HD generated by the hydrofoil 146, 147 is substantially less than the drag BD generated by the buoyant bodies 36, 37 thus allowing the watercraft to continue to accelerate. Water moving across the horizontal portion 126 of rudder 124 similarly generates lift to lift the aft portion of hull 11 clear of the water.

As the craft continues to gather speed, the weight of outrigger assembly 26, 27 forward of pivoting axis 18 in conjunction with the drag HD generated by the hydrofoils 146, 147 cause the blades 136, 137 to pivot abaft to further reduce attack angle AA and the resulting lift LF.

In order to stabilize the above-described dynamics, the forward section of the outrigger assembly 26, 27 relies on the canard 56, 57 for a slight amount of support. The lifting or buoying force CF generated by the canard 56, 57 maintains the outrigger assemblies 26, 27 and hence the attack angles AA of the hydrofoils 146, 147 in the desired position. Additionally, the forward position of the canards 56, 57 helps anticipate the surface contour of the water. When approaching a swell, the canards 56, 57 rise therewith, thereby increasing the hydrofoils' attack angles to generate more lift LF in order to lift the entire watercraft over the swell. A trough has the opposite effect. The pointed configuration of the buoyant effect. The pointed configuration of the buoyant bodies 36, 37 reduces the destabilizing effect when a rather steep change in the water's topography precludes the craft from being lifted thereover in time and buoyant bodies 36, 37 submerge. In effect, the canards 56, 57 sense the water level relative the craft by following the surface contour.

The inherent flexibility of cantilever 46, 47 is central to the practice of the present invention. The majority of the surface irregularities of a body water are too small to justify lifting an entire craft thereover. Moreover, the width of the small irregularities, and hence their effect at speed is too short to actually influence the height of the entire craft. However, while the height of the craft may not in fact be altered, a hydrofoil suspension system as previously discussed would however be adversely effected if cantilever 46, 47 were in fact rigid, and every displacement of canard 56, 57 were to effect a change in the hydrofoils' attack angle. A transient change in the foils' attack angles, even through not capable of effecting the watercraft's ride height, would increase drag, possibly cause cavitation and generally reduces the craft's efficiency. Moreover, if the craft were in fact to react, any phase shift with respect to the point at which a surface irregularity is sensed relative the point at which the craft reacts, could be destabilizing and reduce efficiency. Consequently, the flexibility of the cantilever 46, 47 is selected such that vertical displacements of the canard 56, 57 exceeding a preselected frequency are effectively filtered out and do not effect the attack angle AA of the hydrofoils 146, 147. Such frequency preferably corresponds approximately to the oscillations generated by chop encountered by the watercraft at speed. The flexibility and length of the cantilever 46, 47 must consequently be matched to the rotational inertia of the entire outrigger assembly 26, 27 as well as the beam's resistance to flexure in order to yield the desired filtering effect.

The bi-plane rig of FIGS. 3, 4 offers additional advantages for the purposes of the present invention. The ball-and-socket couplings 156, 157 at the base of the masts 116, 117 effectively isolate the masts from the pivoting of the outrigger assemblies therebelow, while the triangulating stay and strut arrangement 128, 129, 130, 131, 135 effectively ties the masts to the hull 11. As a result, the masts 116, 117 are held stationary relative the pivoting of the outrigger assemblies 26, 27 and the shock absorbers 140, 141 interposed between the masts 116, 117 and a forward section of the buoyant bodies 36, 37 dampen relative movement to further stabilize the craft while encountering surface irregularities.

The flexible beam 15 of the embodiments illustrated in FIG. 1–4 is replaced in FIG. 5 with a rigid beam 150 and spring assembly 222. The rigid beam 150 serves the necessary function of providing attachment points for the outrigger assemblies 26, 27 depending therefrom capable of transferring the lifting forces generated thereby, provides mounting points about which the outriggers can pivot and additionally serves to provide a stationary anchor point for a spring to bias each outrigger assembly, and hence the corresponding hydrofoil's attack angle, into a desired position.

In watercraft configurations wherein the two hydrofoil suspension systems are substantially laterally offset from one another as is shown in FIGS. 2 and 4, the attitude of the entire craft is stabilized. Pitching motion as well as rolling motion is automatically controlled and compensated for. As wind force is applied laterally to the craft, a moment is created that unloads the windward side while loading the leeward side. As the leeward side is pushed downwardly, the apparent water level as sensed by the canard rises which causes the canard via the flexible beam to pivot the hydrofoil to assume a greater attack angle, thus increasing lift to maintain that side of the craft at the desired height above the water. Conversely, as the unloaded windward side starts to rise, the apparent water level as sensed by the respective canard drops which causes the hydrofoils' attack angle to readjust. A smaller attack angle, or even a negative attack angle will maintain the desired height of the windward side of the craft.

The slightly obtuse angle of the opposing L-shaped blade structures 136, 137 additionally assists in maintaining the craft in a level attitude when subjected to lateral wind forces. Despite the presence of the vertical portions of blade structure 136, 137 which function as keels or daggerboards, a finite amount of side slip does result which causes a lateral component of the water flow to act upon the slightly downwardly extending and opposing hydrofoils 146, 147. The lateral water flow impinges on the top surface of the windward hydrofoil to generate a downward force to assist in maintaining the windward side of the craft level, while the lateral water flow impinges on the bottom surface of leeward foil to provide additional lifting force to the leeward side. Thus, the craft's attitude is maintained by the combined effect of an active as well as passive leveling system, the active system being defined by the mechanism for controlling the pivoting of blade structures 136, 137 to actively adjust the hydrofoils' 146, 147 attack angles while the passive system consists of the opposed orientation of two slightly obtuse L-shape blade configurations.

FIG. 6 illustrates an embodiment of the present invention adapted to a conventional hull 300. Because the hull 300 provides all necessary buoyancy, the inclusion of a buoyant body in association with the hydrofoil suspension body is not necessary, hence deleted. The ability to resist leeway movement is also less critical, hence, the support member's 337 surface is reduced.

While a particular form of the invention has been illustrated and described, it will also be apparent to those skilled in the art that various modifications can be made without departing from the spirit and scope of the invention. Accordingly, it is not intended that the invention be limited except as by the appended claims.

What is claimed is:

1. A watercraft, comprising:

a hydrofoil having an adjustable angle of attack, operative to impart a variable amount of lifting force to said watercraft;

means for biasing said hydrofoil to a preselected angle of attack;

a canard, disposed forward of said hydrofoil and operative to follow the water's surface;

a flexible cantilever operative to adjust said hydrofoil's angle of attack as a function of said canard's vertical positioning relative to said watercraft, said cantilever's flexibility being selected such that changes in the canards's position above a preselected frequency do not affect said hydrofoil's angle of attack whereby said watercraft is maintained at a substantially constant height above the water at speed and is not destabilized by local surface irregularities.

2. The watercraft of claim 1, further comprising means to dampen the rate of adjustment of said hydrofoil's attack angle.

3. The watercraft of claim 1, further comprising:

a support member having a proximal end pivotably attached to said watercraft so as to pivot about an axis oriented substantially along the horizontal and substantially perpendicular to said watercraft's longitudinal axis and a distal end to which said hydrofoil is rigidly attached; and wherein said biasing means comprises a means for biasing said support member towards a position wherein said hydrofoil assumes a preselected attack angle whereby a pivot force applied to said support member causes said hydrofoil's attack angle to change.

4. The watercraft of claim 3 wherein said canard comprises a float.

5. The watercraft of claim 3 wherein said canard comprises a planing body.

6. The watercraft of claim 3 wherein said flexible cantilever is operative to apply a pivoting force to said support member to increase said hydrofoil's attack angle as said canard rises relative said watercraft and to decrease said hydrofoil's attack angle as said canard falls relative said watercraft and wherein the flexibility of said cantilever is selected so that substantially no motion is imparted to said support member in response to said canard rising and falling at or above a preselected frequency.

7. The watercraft of claim 6 further comprising a shock absorber operative to dampen the pivoting of said support member.

8. The watercraft of claim 6 wherein a torsionally flexible beam extends substantially laterally from said watercraft to which is rigidly attached in a radially extending orientation, the proximal end of said support member wherein torsional displacement of said beam causes said support member to pivot and said beam's inherent resistance to torsional displacement comprises said biasing means.

9. The watercraft of claim 8 further comprising a buoyant body affixed to said flexible beam operative to impart a buoying force to said watercraft when the water level is high relative said watercraft.

10. The watercraft of claim 9 wherein the center of buoyancy of said buoyant body is disposed relative said flexible beam's axis so that buoying forces generated thereby, and by said canard, impart a torsional displacement of said beam to substantially increase said hydrofoil's attack angle when said water level is high relative said watercraft.

11. The watercraft of claim 10 wherein a shock absorber dampens torsional displacements of said beam.

12. The watercraft of claim 6 wherein a torsionally rigid beam extends substantially laterally from said watercraft to which is pivotably attached in a radial orientation, the proximal end of said support member and wherein a spring maintains said support member in a preselected position.

13. The watercraft of claim 12 further comprising a buoyant body in communication with said support member to impart buoying force to said watercraft when the water level is high relative said watercraft.

14. The watercraft of claim 13 wherein said buoyant body's center of buoyancy is displaced forwardly relative said pivoting axis of said member so as to pivot said support member against said spring to substantially increase said hydrofoil's attack angles when said water level is high relative said watercraft.

15. The watercraft of claim 14 wherein a shock absorber dampens the pivoting of said support member.

16. The watercraft of claim 1 wherein said hydrofoil is laterally offset from the watercraft's longitudinal axis, is angled slightly downwardly towards the craft and is supported by a substantially vertical keel member for opposing lateral forces wherein said hydrofoil and keel member define a slightly obtuse L-shape.

17. The watercraft, comprising:

two hydrofoils, one mounted on each side of said watercraft, each hydrofoil having an independently adjustable angle of attack, operative to impart a variable amount of lifting force to either side of said watercraft;

means for biasing each hydrofoil to a preselected angle of attack;

two canards, one positioned forward of each of said hydrofoils and operative to follow the water's surface;

two flexible cantilevers, each operative to adjust one of said hydrofoil's angle of attack as a function of the vertical positioning of the respective canard relative said watercraft, said cantilevers's flexibility being selected such that changes in the canards's positions above a preselected frequency do not affect said hydrofoils' angles of attack whereby said craft maintains a substantially constant height and attitude above the water at speed and is not destabilized by local surface irregularities.

18. The watercraft of claim 17 comprising a torsionally flexible beam extending laterally across said watercraft, rigidly attached at its center to the watercraft and having rigidly attached at either end a radially extending support member to which one of said hydrofoils is attached, whereby torsional displacement of said beam causes said support member to pivot and adjust said hydrofoils' attack angle and whereby said beam's inherent resistance to torsional displacement comprises said biasing means.

19. The watercraft of claim 18 wherein said canards comprise floats.

20. The watercraft of claim 18 wherein said canards comprise planing bodies.

21. The watercraft of claim 18 further comprising buoyant bodies disposed near the ends of said flexible beam so as to impart buoying forces to said watercraft when the water level is high relative the watercraft.

22. The watercraft of claim 21 wherein said buoyant bodies are disposed and attached to said flexible beam such that any buoying forces generated thereby in addition to any buoying forces generated by said canard cause said beam to flex and substantially increase said hydrofoils' attack angles.

23. The watercraft of claim 22, wherein each of said canards is connected to one of the said buoyant bodies via said forwardly extending flexible cantilever.

24. The watercraft of claim 23 wherein shock absorbers dampen torsional displacement of said flex beam.

25. The watercraft of claim 23 wherein said watercraft is windpowered.

26. The watercraft of claim 25 wherein a bi-plane rig is employed to power said watercraft and wherein one of each of said planes is rigged substantially over each hydrofoil.

27. The watercraft of claim 26 wherein each plane is rigged so as to be isolated from any attack angle adjusting movements.

28. The watercraft of claim 27 further comprising a shock absorber extending between each rigged plane and said buoyant body so as to dampen torsional displacements of said flexible beam.

29. The watercraft of claim 27 further comprising an inverted T-shaped rudder wherein the vertical portion of the rudder provides steering control and the horizontal portion of the rudder is foil-shaped to impart lifting forces to the aft section of said watercraft at speed.

30. The watercraft of claim 18 wherein said support members are substantially vertically oriented and formed to oppose lateral movement of the watercraft and wherein each hydrofoil is attached to one of said support members so as to define a slightly obtuse L-shape wherein the hydrofoils are oriented towards one another and are angled slightly downwardly.

31. The watercraft of claim 17 comprising:

a torsionally rigid beam extending laterally across said watercraft, rigidly attached at its center to said watercraft and having pivotably attached at each end, a radially extending support member to which one of said hydrofoils is attached; and means for biasing each support member and hence each hydrofoil attack angle to a preselected position.

32. The watercraft of claim 31 wherein said support members are substantially vertically oriented and formed to oppose lateral movement of the watercraft and wherein each hydrofoil is attached to one of said support members so as to define a slightly obtuse L-shape wherein the hydrofoils are oriented towards one another and are angled slightly downwardly.

33. The watercraft of claim 31 wherein said canards comprise floats.

34. The watercraft of claim 31 wherein said canards comprise planing bodies.

35. The watercraft of claim 31 further comprising buoyant bodies affixed to said support member so as to impart buoying forces to said watercraft when the water level is high relative the watercraft.

36. The watercraft of claim 35 wherein said buoyant bodies are disposed so that buoying forces generated in addition to any buoying forces generated by said canards cause said support members to pivot and substantially increase said hydrofoils' attack angles.

37. The watercraft of claim 36 wherein each of said floats is connected to one of said buoyant bodies via said forwardly extending flexible cantilever.

38. The watercraft of claim 37 wherein shock absorbers dampen pivoting displacement of said support member.

39. The watercraft of claim 37 wherein said watercraft is windpowered.

40. The watercraft of claim 39 wherein a biplane rig is employed to power said watercraft and wherein one of each of said planes is rigged substantially over each hydrofoil.

41. The watercraft of claim 40 wherein each plane is rigged so as to be isolated from any attack angle adjusting movements.

42. The water craft of claim 41 further comprising a shock absorber extending between each rigged plane and said buoyant body so as to dampen pivoting movements of said support members.

43. The watercraft of claim 42 further comprising an inverted T-shaped rudder wherein the vertical portion of the rudder provides steering control and the horizontal portion of the rudder is foil-shaped to impart lifting forces to the aft section of said watercraft at speed.

* * * * *